United States Patent [19]

Greenlee

[11] 4,019,632

[45] Apr. 26, 1977

[54] TOOL HANDLE DISPLAY AND HANGER DEVICE

[75] Inventor: Hugh T. Greenlee, Gates Mills, Ohio

[73] Assignee: The Wright Tool & Forge Co., Barberton, Ohio

[22] Filed: May 11, 1976

[21] Appl. No.: 685,349

[52] U.S. Cl. ..... 206/349; 206/378; 206/463; 206/486; 206/488

[51] Int. Cl.[2] ..... B65D 61/00; B65D 85/20

[58] Field of Search ..... 206/486, 349, 378, 463, 206/488, 489, 375, 45.31, 427, 425; 229/87 H

[56] References Cited

UNITED STATES PATENTS

| | | | |
|---|---|---|---|
| 1,569,679 | 1/1926 | Sanborn | 206/485 |
| 3,298,516 | 1/1967 | Leopold | 206/378 |
| 3,370,733 | 2/1968 | Giesler | 206/463 |
| 3,516,585 | 6/1970 | Inwood | 206/349 |
| 3,846,030 | 11/1974 | Katt | 285/4 |

*Primary Examiner*—William T. Dixson, Jr.
*Attorney, Agent, or Firm*—Bosworth, Sessions & McCoy

[57] ABSTRACT

A holder and display device for a socket wrench tool drive component such as a ratchet handle or the like. The drive component is of conventional design and has an operating head and a relatively thin elongated cylindrical stem portion connecting the head to a handle. The display and hanger device is formed of relatively thin flat rigid formable plastic material and has a rectangular opening at its lower end portion of sufficient size to permit positioning therein of the operating head with the stem portion extending downwardly therefrom. The opening is defined by two parallel side portions and a bottom portion, the bottom portion having a semi-cylindrical hump formed therein with an inner diameter corresponding to the inner diameter of the stem. A rectangular strip is initially formed contiguous with the bottom portion and with a semi-cylindrical hump formed therein corresponding in size and shape to the hump in the bottom portion. The rectangular strip is easily removable from the bottom portion and is adapted to be secured in reverse relation back-to-back to the rearward side of the bottom portion to define an annular collar. Accordingly, the rectangular strip is secured to the back of the bottom portion with the stem positioned in the collar and with the operating head in the opening. The upper end of the display and hanger device has a hole adapted to be used to hang the device and the socket wrench tool drive component carried thereby on a hook or rod for display at the point of sale.

1 Claim, 4 Drawing Figures

TOOL HANDLE DISPLAY AND HANGER DEVICE

BACKGROUND OF THE INVENTION

This invention relates to the display of socket wrench tool sets and especially to the display of the individual tool drive components that are used with different sockets to engage and turn a threaded fastener such as a machine screw, a bolt, etc. More particularly, the invention relates to the combination of a socket wrench drive component and a display and hanger device therefor that is securely anchored to the drive component for display thereof at the point of sale.

Socket wrench tool sets are usually displayed at the point of sale in the boxes or other packaging in which the tool sets are transported and stored. This method of display has certain disadvantages that detract from the marketing appeal of the product. One disadvantage is that the various components of the tool sets are not easily seen by prospective purchasers and cannot be easily handled and manipulated. Another disadvantage is that packaging of the complete socket wrench tool set does not readily accommodate the separate display and sale of individual socket wrench tool drive components.

With the introduction of the UPC coding system another problem arises. Since some form of tags or labels containing printed matter must be attached to each component, it is necessary that each separate socket wrench tool drive component be provided with a tag or label containing sufficient area--usually at least one square inch to permit the UPC code to be applied and readily displayed.

The device of the present invention resolves the difficulties indicated above and affords other features and advantages heretofore not obtainable.

SUMMARY OF THE INVENTION

It is among the objects of the invention to hold and display individual socket wrench tool drive components in a manner that permits the drive component to be handled and manipulated by a customer at the point of sale and that permits a substantial amount of sales information to be displayed with the individual drive component.

Another object is to more effectively display and hang socket wrench tool drive components individually at the point of sale.

These and other objects and advantages are accomplished with the unique combination of the invention which includes a socket wrench tool drive component and a display and hanger device therefor. The drive component has an enlarged operating head such as a ratchet head and a relatively thin elongated cylindrical stem portion connecting the head to a handle.

The display and hanger device is formed of relatively thin flat rigid formable plastic sheet material and has a rectangular opening at its lower portion of sufficient size to permit positioning of the operating head of the tool component therein. The opening is defined in part by two parallel side portions and a bottom portion, the bottom portion having a semi-cylindrical hump formed therein with an inner diameter corresponding to the diameter of the stem.

The device also includes a rectangular strip of plastic material initially formed contiguous with and adjacent to the bottom portion. The rectangular strip likewise has a semi-cylindrical hump formed therein corresponding in size and shape to the hump in the bottom portion. The rectangular strip is easily removed from the bottom portion and is adapted to be secured in reverse relation, back-to-back to the rear face of the bottom portion with the respective humps in opposed relation to define an annular collar. Accordingly, the drive component is adapted to be positioned with the operating head in the opening and the stem in the annular collar when the rectangular strip is secured to the bottom portion.

The upper end of the display and hanger device has a hole to permit hanging of the device with the tool drive component attached thereto, on a hook or a rod.

DESCRIPTION OF THE PREFERRED EMBODIMENT

Figure 1:
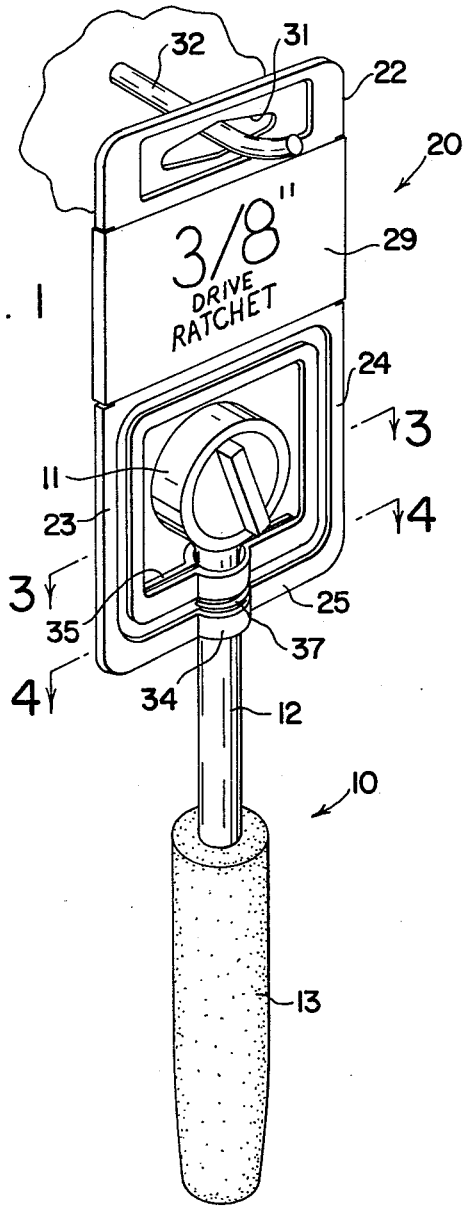
FIG. 1 is a perspective view of a socket wrench tool drive component displayed and hung by a device in accordance with the combination of the invention, the display device and drive component being supported on a hook.

Referring more particularly to the drawings, there is shown a socket wrench drive component 10 and a display and hanger device 20 therefor in accordance with the combination of the invention. The socket tool drive component 10 has a reversable ratchet head 11 in accordance with constructions well known to those skilled in the art, a relatively thin elongated cylindrical stem 12 and a handle 13. It will be understood, of course, that whereas a reversable ratchet type socket drive component is illustrated herein, other types of drive components are also pertinent to the combination of the invention.

Figure 3:
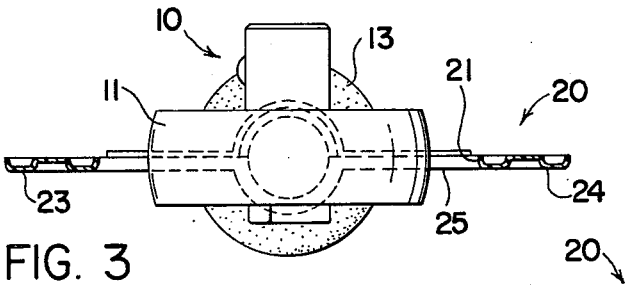
FIG. 3 is a sectional view taken on the line 3—3 of FIG. 1.
Figure 4:
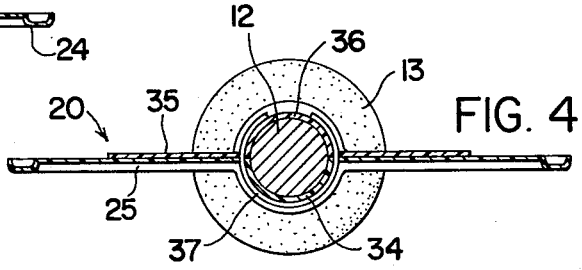
FIG. 4 is a sectional view taken on the line 4—4 of FIG. 1.

As illustrated in FIGS. 1, 3 and 4, the tool drive component 10 is attached to a display and hanger device 20 in accordance with the invention. The device 20 is formed of relatively flat, rigid, plastic sheet material and has a rectangular opening 21 in the lower portion thereof of sufficient size to receive the reversable ratchet head 11. The opening 21 is defined by the adjacent upper portion 22 of the device, two parallel side portions 23 and 24 and a bottom portion 25.

The upper portion 22 of the device has a neck portion 26 with relieved side edges 27 and 28 adapted to receive a paper label 29 which is tightly wrapped therearound. The neck portion 26 prevents the paper label from being slid off of the device 20.

At the uppermost end of the device 20, a hole 31 is provided to permit the device to be hung on a hook or rod such as the hook 32 of FIG. 1. The bottom portion 25 is provided with a semi-cylindrical central hump 34 with an inner diameter approximately corresponding to the diameter of the stem 12.

Figure 2:
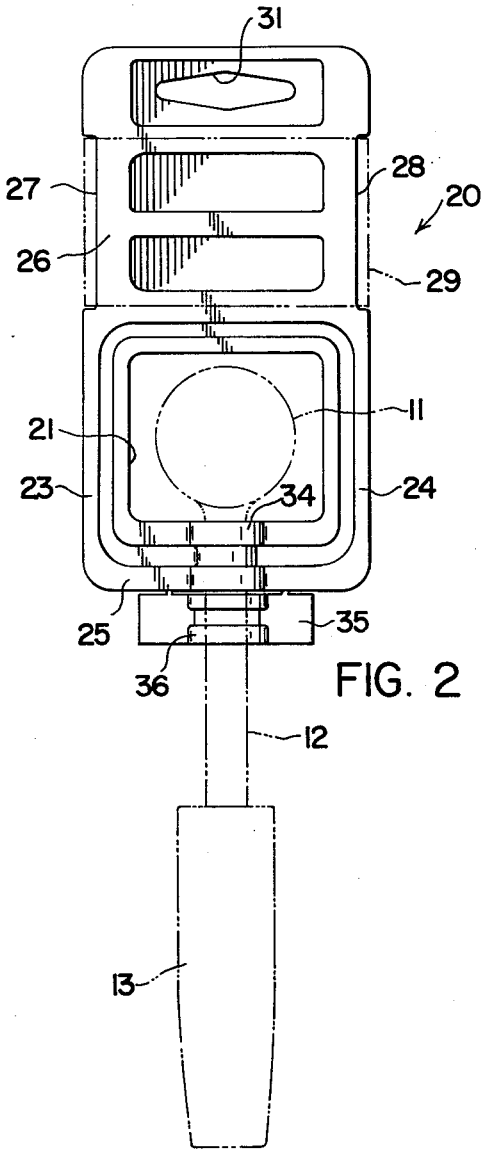
FIG. 2 is an elevational view of a display and hanger device embodying the invention prior to its being secured to a socket wrench tool drive component which is shown in phantom lines.

Referring to FIG. 2, it will be seen that the device 20 is initially formed with a rectangular strip 35 adjacent the bottom portion 25. The rectangular strip 35 likewise is provided with a semi-cylindrical central hump 36 corresponding in size and shape to the hump 34.

In the assembly of the combination of the invention, the rectangular strip 35 is removed from its position illustrated in FIG. 2 (such as by tearing) and placed on the rearward side of the bottom portion 25 in back-to-back relation as illustrated in FIGS. 1 and 4, with its hump portion 36 in reverse relation to the hump portion 34 and with the stem 12 of the drive component 10 positioned between the humps. The rectangular strip 35 is then stapled (such as with the annular staple 37) or otherwise secured to the bottom portion 25 to define a collar that surrounds and grips the stem 12 with the ratchet head 11 positioned in the opening 21.

In the preferred form the collar is provided with an annular groove and the annular staple 37 is applied in the groove and thus snugly surrounds and clamps the stem in the collar.

With the drive component 10 held and displayed in this way, a prospective customer may handle the component, manipulate the ratchet head 11 and otherwise carefully inspect the product at the point of sale. The holder and display device 20, however, is securely anchored to the drive component 10 to inhibit pilferage.

While the invention has been shown and described with respect to specific embodiments thereof this is intended for the purpose of illustration rather than limitation and other variations and modifications of the specific combinations herein shown and described will be apparent to those skilled in the art all within the intended spirit and scope of the invention. Accordingly, the patent is not to be limited in scope and effect to the specific combinations herein shown and described nor in any other way that is inconsistent with the extent to which the progress in the art has been advanced by the invention.

I claim:

1. In combination a socket wrench tool drive component and a display and hanger device therefor, said drive component having an enlarged operating head and a relatively thin elongated stem portion connected to said head, and said display and hanger device being formed of relatively thin, flat, rigid formable plastic material and having a rectangular opening at its lower portion of sufficient size to permit positioning of said operating head therein said opening being defined by two parallel side portions and a bottom portion, said bottom portion having a semi-cylindrical hump formed therein with an inner diameter corresponding to the diameter of said stem, and said display and hanger device also having a rectangular strip initially formed contiguous with and generally coplanar with said bottom portion and having a semi-cylindrical hump formed thereon corresponding in size and shape to said hump in said bottom portion, said rectangular strip being readily removable from said bottom portion and adapted to be secured back-to-back to the rear face of said bottom portion with said humps in reverse relationship to define an annular collar adapted to receive said stem to retain and secure said drive component to said display and hanger device with said operating head in said opening, and means defining a hole in said display and hanger device for hanging said device and said drive component on a hook.

* * * * *